US007264583B2

(12) United States Patent
Gelli et al.

(10) Patent No.: US 7,264,583 B2
(45) Date of Patent: Sep. 4, 2007

(54) FOLDING MACHINE WITH TRANSFERRING DEVICE OF THE FOLDED PRODUCTS THAT PENETRATES THE FOLDING ROLLER

(75) Inventors: Mauro Gelli, Lucca (IT); Alessandro Morelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 65 days.

(21) Appl. No.: 10/563,301

(22) PCT Filed: Jul. 2, 2004

(86) PCT No.: PCT/IT2004/000370

§ 371 (c)(1),
(2), (4) Date: Jan. 4, 2006

(87) PCT Pub. No.: WO2005/003010

PCT Pub. Date: Jan. 13, 2005

(65) Prior Publication Data

US 2006/0180625 A1 Aug. 17, 2006

(30) Foreign Application Priority Data

Jul. 4, 2003 (IT) ..... FI2003A0185

(51) Int. Cl.
*B31F 1/00* (2006.01)

(52) U.S. Cl. ..... 493/430; 493/360; 493/416; 493/424

(58) Field of Classification Search ..... 493/360, 493/408, 409, 410, 416, 424, 425, 426, 429, 493/430, 442, 454
See application file for complete search history.

(56) References Cited

U.S. PATENT DOCUMENTS

| | | | | |
|---|---|---|---|---|
| 1,186,018 | A * | 6/1916 | Meisel | 493/430 |
| 1,791,569 | A * | 2/1931 | Novick | 493/430 |
| 2,359,417 | A * | 10/1944 | Hand | 493/430 |
| 4,770,402 | A * | 9/1988 | Couturier | 493/410 |
| 4,938,465 | A * | 7/1990 | Marsiletti | 493/412 |
| 5,730,695 | A * | 3/1998 | Hauschild et al. | 493/416 |
| 6,120,240 | A | 9/2000 | Ghilardi | |
| 6,213,927 | B1 * | 4/2001 | De Matteis et al. | 493/430 |

FOREIGN PATENT DOCUMENTS

| | | |
|---|---|---|
| EP | 0 294 675 A2 | 12/1988 |
| EP | 0 294 675 A3 | 12/1988 |
| WO | WO 01/62651 A1 | 8/2001 |
| WO | WO 02/12102 A1 | 2/2002 |
| WO | WO 02/14196 A1 | 2/2002 |

* cited by examiner

*Primary Examiner*—Louis Huynh
(74) *Attorney, Agent, or Firm*—Breiner & Breiner, LLC

(57) ABSTRACT

The folding machine comprises a pair of folding rollers (1, 3) rotating about axes essentially parallel to each other and defining a nip (5) through which a web material (N) to be folded passes. Disposed on each of the folding rollers are folding members (61, 61A; 63, 63A) which form folds on the web material parallel to the axis of rotation of the folding rollers. For each folding roller (1, 3) a transferring device (11, 13) is also provided to transfer packs of products folded by the folding rollers towards an unloading area (9), which comprises a plurality of separating fingers (15) movable along a closed path, from an area of engagement with the folded products to an unloading area of the folded products. Each of the transferring devices extends inside an annular groove (1G, 3G) of the respective folding roller (1, 3).

24 Claims, 5 Drawing Sheets

71
3
3G
D
15
13
61A
63
V
V
63A
C
61
VI
65
P
D
P1
f3
7
73
FN
VI
N
5
61A
61
P2
F1
1
C
21
43
15
11
19
1G
C
63
63A

FOLDING MACHINE WITH TRANSFERRING DEVICE OF THE FOLDED PRODUCTS THAT PENETRATES THE FOLDING ROLLER

This application is a 371 national stage application of PCT/IT04/00370 filed Jul. 2, 2000 which claims the benefit of priority of the Italian application FI 2003 A 000185 filed on Jul. 4, 2003.

DESCRIPTION

1. Technical Field

The present invention relates to a folding machine, in other words to a machine used to fold a continuous web material, transversely to the longitudinal extension of the product, to produce individual cut and folded products, comprising a transferring device to transfer packs of products towards an unloading area.

2. State of the Art

Folding machines are commonly used to produce paper napkins and handkerchiefs. Folding machines frequently used to produce napkins folded in two or in four are equipped with a pair of counter-rotating rollers with parallel axes, between which the continuous web material is fed. The rollers are equipped with folding members which make the transverse fold of the web material. The folding members are controlled and staggered to work alternately, so that the web material is folded once on one roller and the subsequent time on the other. A continuous web product folded in a zigzag configuration is thus delivered from the pair of folding rollers, and subsequently pushed against a central blade that divides the pack of folded layered material into two stacks of cut products.

Examples of folding machines of this type are described in U.S. Pat. No. 6,120,240 and in WO-A-0214196. The pack of web material folded in a zigzag configuration downstream of the pair of folding rollers must be divided into individual packs each containing, after the cut performed by the blade, the required number of individual products. For this purpose, known folding machines have a transferring device associated with each folding roller, which comprises a series of fingers sliding in a guide defining a closed path. Each finger is taken to a position adjacent to the respective folding roller and with an abrupt inserting movement is brought behind the last edge of folded material destined to form the last product of each pack.

This layout poses a limit to the number of folding members that can be disposed on each roller and, consequently, to the production speed of the machine. In fact, for there to be no interference between the transferring device and the respective folding roller the transferring device must be placed at a certain angular distance, of almost 180°, with respect to the nip between the folding rollers, that is, with respect to the area in which the fold is formed. This means that a maximum of one folding member can be placed on each folding roller. Folding member is intended as a mechanical or pneumatic member which, grasping the web material along a line parallel to the axis of the roller, engages it to produce the fold. It may cooperate with a wedge or blade used to push the web material into the folding member. When blades or wedges are provided to facilitate the fold, in known machines each folding roller comprises a folding member, for example a mechanical folding gripper, and a wedge, staggered by 180°.

Object and Summary of the Invention

The object of the present invention is to prevent or reduce the drawbacks of known machines and in particular to increase productivity and/or reduce stresses with the same amount of productivity.

This and other objects and advantages, which shall be clear to those skilled in the art by reading the text hereunder, are obtained in substance with a folding machine comprising: a pair of folding rollers rotating about axes parallel to each other and defining a nip through which a web material to be folded passes, disposed on each of which are folding members that form folds on the web material parallel to the axis of rotation of the folding rollers; and, for each of the folding rollers, a transferring device, to transfer packs of folded products from the folding rollers towards an unloading area, which comprises a plurality of separating fingers movable along a closed path, from an area of engagement with the folded products to an unloading area of the products folded and divided into packs containing a predefined number of products. Characteristically, according to the invention, each of the transferring devices extends inside an annular groove of the respective folding roller. More specifically, each of said transferring devices comprises a sliding track or guide, inside which the fingers, which project from said track, are guided. According to the invention, the track inside which the fingers are guided also interferes with the surface of the respective folding roller penetrating the annular groove of the roller.

In this way it is possible to bring the end of the transferring device, which is at the level of the folding area, closer to the folding nip between the folding rollers. Consequently, as shall become clearer hereunder, with reference to one embodiment, it is possible to position more than one folding member on each folding roller, consequently making it possible to increase the production speed.

In a per se known way, on each of said folding rollers at least one folding gripper or other folding member is provided, and preferably at least two folding grippers, or other equivalent folding members, oscillating about axes parallel to the axis of rotation of the respective folding roller, interrupted at the level of the annular groove, to allow interpenetration of the fingers and of the sliding track of the fingers.

In principle, each folding gripper may be controlled by two coaxial shafts operated synchronously: the first controls the upper portion of folding blade and the second controls the lower portion of folding blade with respect to the position of the transferring device. The folding grippers may also be produced in two portions, interrupted at the level of the annular groove inside which the transferring device penetrates. Nonetheless, this would make the machine particularly complex. To obtain a particularly advantageous, low-cost and reliable configuration, according to a preferred embodiment of the invention each folding gripper is equipped with an oscillating control shaft, with an elbow configuration at the level of the annular groove, the transferring device interfering with the axis of oscillation of said control shaft. It is thus possible to produce a simple control at only one end of the shaft to obtain the oscillating motion of the folding grippers, utilizing for this purpose mechanisms essentially equivalent to those currently known on traditional machines.

In a practical embodiment, the separating fingers extend more or less orthogonal to the track defining the closed path and have respective guide bases engaging slidingly in the track of the respective transferring device. Moreover, the track advantageously has an essentially rectilinear forward section, extending from the folding rollers to the unloading area of the packs of products, and a return section. The forward and return sections are connected by a first curvilinear end portion, adjacent to the respective folding roller and a second curvilinear end portion adjacent to the unloading area, and the first curvilinear end portion is located at least partially in the annular groove of the respective folding roller.

Although in principle it is possible to convey the separating fingers along the closed path by the effect of the push of the folded web material which is fed upstream of each finger, for more regular operation it is preferable for each transferring device to have a flexible continuous member to convey the separating fingers along said closed path. This flexible member may cooperate with the guide bases of the individual separating fingers.

To reduce the overall height of the transferring device, according to an advantageous embodiment the flexible member is located inside the closed path along which the guide bases of said fingers move, having a height not extending the vertical dimension of said guide bases. In this case, the flexible member can, for example, act on a surface of said guide bases facing the inside of the closed path.

In a per se known way, in an embodiment of the invention a rotating inserting member is associated with the end of the track of the transferring device adjacent to the folding area; said rotating inserting member picks up the separating fingers from the return section of the track and inserts them into the forward section of the track, making the fingers travel the corresponding curvilinear end portion of said track. In a particular embodiment of the invention, the rotating inserting member also penetrates the annular groove of the corresponding folding roller.

In a possible embodiment of the invention, the sliding track and the path of the flexible conveying member are configured so that along a terminal part of the return section of the track, inside which the fingers slide, and along a part of the first curvilinear end portion of said track—in proximity to the unloading area—the separating fingers are not in contact with the flexible conveying member. For this purpose, the flexible member may, for example, be driven around a first guiding wheel associated with the rotating inserting member, the axis of rotation of the first guiding wheel and the axis of rotation of the rotating inserting member being parallel and eccentric. This eccentricity, the diameter of said first guiding wheel and the diameter of the curvilinear end portion of the track of the separating fingers are arranged and dimensioned so that the bases of the inserting fingers are not in contact with the flexible member for an angle ranging from approximately 90° to approximately 120° of the curvilinear end portion of the track, the fingers being brought into contact with the flexible member by the rotating inserting member at the end of said curvilinear end portion of the track, in the area of connection with the rectilinear forward section of the path of the fingers.

To reduce the overall height of the portion of the transferring member which must penetrate the nip of the folding roller, in a particularly advantageous embodiment of the invention the rotating inserting member is controlled by a driving wheel that meshes therewith, positioned on the outside of the annular groove of the folding roller.

Advantageously, the continuous flexible member may be a belt comprising a base layer and a shaped coating, cooperating with corresponding grooves in the bases of the separating fingers. The base may have a flexible structure, although resistant and essentially not extensible, to guarantee the dimensional stability of the belt, while the shaped coating has a high coefficient of friction to adhere to the separating fingers and guarantee they are conveyed, and may be relatively soft.

Advantageously, a rotating sprocket may be disposed at the level of the second curvilinear end portion of the sliding track for the separating fingers, which picks up the fingers from the forward rectilinear section and transfers them to the return section of said track. Preferably, also at the level of said second curvilinear end portion the continuous flexible member may not be in contact with the bases of the separating fingers, in order to obtain rapid transfer at a greater speed to the forward speed of the flexible member.

BRIEF DESCRIPTION OF THE DRAWINGS

The invention shall now be better understood following the description and accompanying drawing, which shows a non-limiting practical embodiment of the invention. In the drawing, where equivalent parts are indicated with the same reference numbers.

DETAILED DESCRIPTION OF THE PREFERRED EMBODIMENTS OF THE INVENTION

Figure 1:
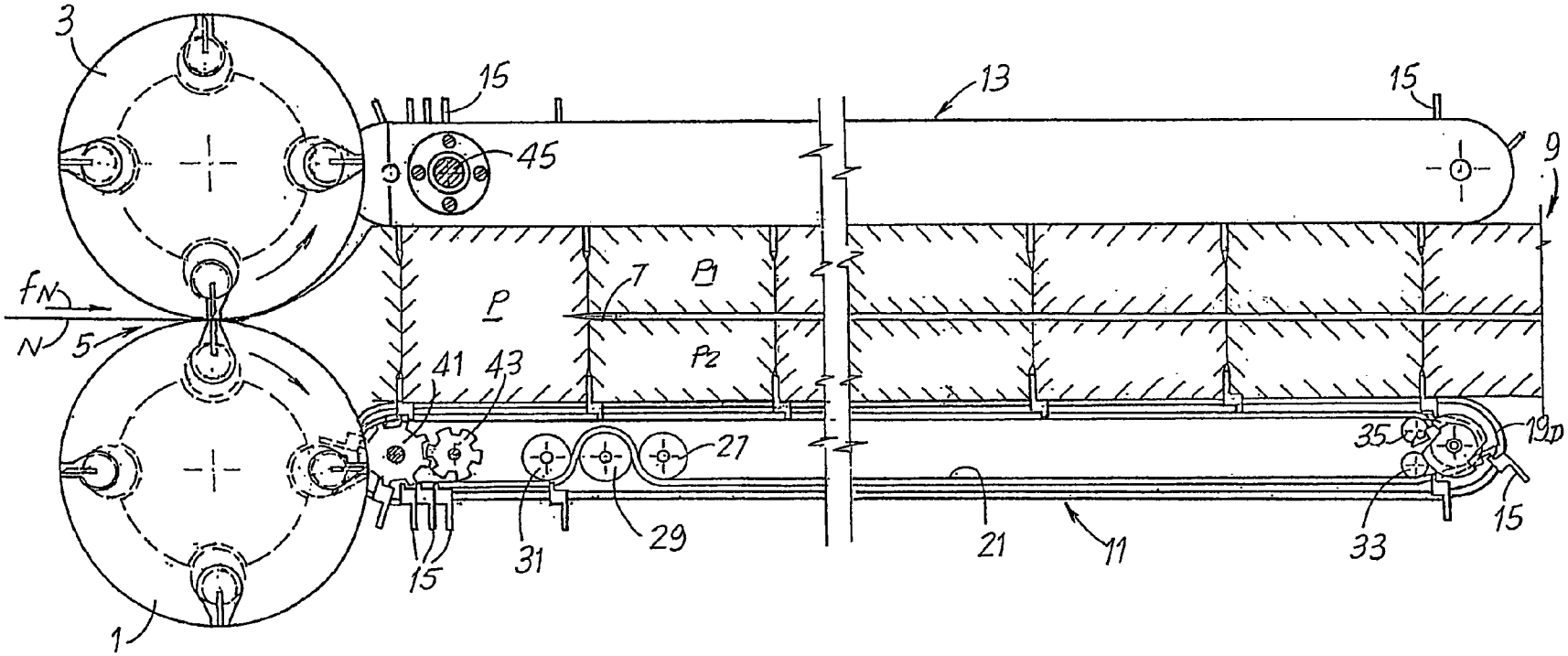
FIG. 1 shows a schematic plan view of the folding machine with the two folding rollers and the two transferring devices.

The folding machine comprises a pair of folding rollers 1, 3 with parallel axes, defining a folding nip 5, into which a web material N, which may have been folded longitudinally previously, is fed according to the arrow fN. The directions of rotation of the folding rollers 1 and 3 are indicated with f1 and f3.

By means of folding members, which shall be described in greater detail hereunder, the continuous web material N is folded transversely in a zigzag configuration to form a pack of folded material, downstream of the folding nip 5. This pack, indicated with P, is pushed gradually, by the continuous feed of new material N and by the pushing action of mechanical finger members, described hereunder, towards a cutting blade 7, the cutting edge of which is parallel to the axes of the folding rollers, which blade—in a per se known way—cuts the pack of material P folded in a zigzag configuration into two stacks of single products, folded, indicated with P1 and P2. These are fed to an unloading area in which, by means of known means (not shown), they are overturned and fed to a packaging machine. The unloading area is indicated generically with 9.

Before reaching the unloading area the products forming the stacks P1, P2 must be divided into individual packs, each containing a predeterminable number of products, in order to obtain on delivery from the packaging line packs containing a known number of products, such as paper napkins or handkerchiefs.

For this purpose, and also in order to feed the stacks P1 and P2 in a controlled way towards the unloading area 9, two transferring devices are provided, indicated as a whole with 11 and 13, associated with the folding rollers 1 and 3 respectively. The two transferring devices are essentially symmetric to each other with respect to the median plane of the machine. Each transferring device comprises a plurality of separating fingers 15 each equipped with a shaped base 17 (see in particular FIG. 4), sliding in a track or guide 19 provided in the corresponding transferring device 11 or 13. The track 19 defines a closed path which has a rectilinear forward section, indicated with 19A, which extends from an area adjacent to the respective folding roller to the unloading area 9, and a rectilinear return section 19B, which extends in the opposite direction. The two rectilinear sections 19A, 19B are connected to each other by a first curvilinear end portion 19C (essentially an arc of circumference) and by a second curvilinear end portion 19D (also essentially an arc of circumference).

As can be seen in the figures, each transferring device 11, 13 considerably penetrates an annular groove 1G, 3G of the respective folding roller 1, 3. More specifically, not only the fingers 15 penetrate the respective folding roller 1 or 3, but also essentially all or most of the curvilinear portion 19C of the track 19 and consequently the organs defining it, constituted by a shaped base 12 and by a cover 14, as well as other mechanical members which shall be described hereunder, contained between the elements 11A and 11B.

Housed inside each transferring device 11, 13 is a flexible member constituted by a belt with a shaped section 21. This belt is driven around a first guiding wheel 23, disposed in proximity of the arcuate portion 19C of the guide track of the fingers 15, with its axis of rotation slightly eccentric with respect to the center of curvature of the portion 19C. At the level of the opposite end of the transferring device 11, 13, the belt 21 is driven around a second idle guiding wheel 25. Disposed between the two wheels 23 and 25 are three guiding wheels 27, 29, 31 arranged towards the wheel 23, while disposed adjacent to the wheel 25 are two small symmetric guiding wheels 33, 35. The wheel 29 is motorized. The layout of these guiding wheels is such that between the wheel 33 and the wheel 27 and between the wheel 23 and the wheel 35 the belt 21 is in contact with the fingers 15 which transit in the corresponding portion of the track 19 and convey them along said track. Vice versa, in the section between the wheels 33, 25 and 35 and in the section between the wheels 27 and 23 the belt 21 is positioned farther towards the inside of the closed path defined by the sliding track 19 of the fingers 15 and thus is not in contact with them. Thanks to the eccentricity of the wheel 23 with respect to the arcuate (circular) portion 19C of the track 19, the belt 21 is out of contact with respect to the fingers 15 by an angle $\alpha$ (FIG. 3) equivalent to approximately 150-160°.

Along these portions of the track 19 in which the fingers 15 are not in contact with the belt 21 they can move at a different speed with respect to the speed imposed by the belt, for the purposes explained hereunder.

Figure 4:
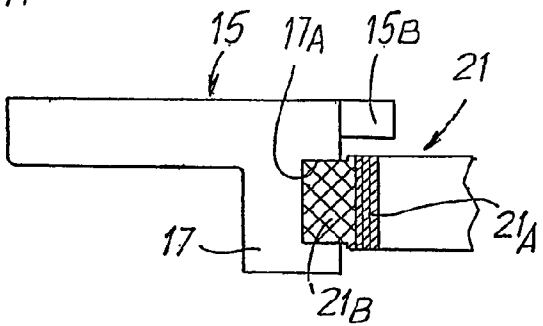
FIG. 4 shows a cross section of the flexible conveying member of the separating fingers.

As can be seen in FIG. 4, the belt 21 is formed by two layers: a first innermost layer 21A with a flat rectangular cross-section provides the tensile strength and elongation strength, while a second layer 21 B with a shaped cross-section is softer and has a high coefficient of friction. This portion is destined to cooperate with the separating fingers 15. For this purpose these have a slot 17A in their base 17, which the portion 21B of the belt penetrates to create grip through friction and convey the fingers.

Due to the fact that between the wheel 27 and the wheel 23 the separating fingers 15 are released from the belt 21, in this section of the track 19 a storage area is created for the separating fingers 15, which are picked up one at a time by an inserting member constituted, in the example shown, by a sprocket 41 with stepped rotation about the axis A, whereon the center of the circular portion 19C of the track 19 lies, eccentric with respect to the axis B of the wheel 23. The sprocket 41 has a series of teeth 41A which engage with appendices 15B of the fingers 15 to convey them in rotation with said sprocket.

The rotational movement of the sprocket 41 is provided through a toothed wheel 43 which engages with the teeth 41B of the sprocket 41 by means of its own toothing, and which takes its movement from a shaft 45 through a free wheel mechanism 47. The shaft 45 is made to oscillate by means of a rod 49 of an actuator and the movement in one direction of said shaft is transmitted, by means of the free wheel mechanism 47 and the toothed wheel 43, to the sprocket 41. The shaft 45, the free wheel mechanism 47 and the toothed wheel 43 are located outside the annular groove 1G or 3G of the corresponding folding roller, so that they do not influence the height of this groove.

Figure 3:
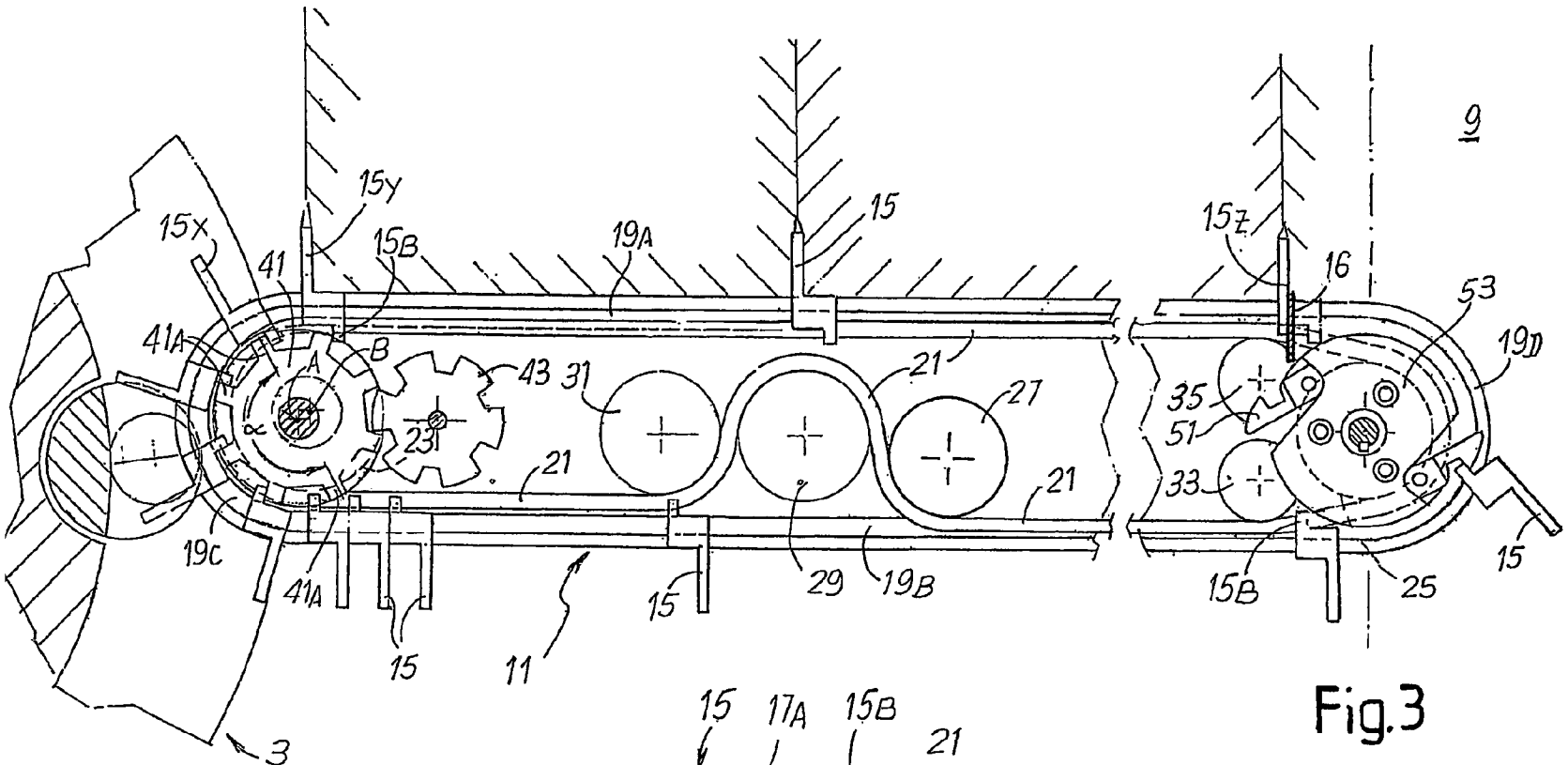
FIG. 3 shows a plan view of an enlargement of one of the two transferring devices with the upper cover removed.

With each oscillation of the shaft 45, the free wheel 43 impresses on the sprocket 41 the movement of one step to bring a separating finger 15 from a standby position, outside the folding area, to an active position, which interferes with the path of the web material folded in a zigzag configuration. In FIG. 3 these two positions are indicated with 15X and 15Y respectively. The movement is sufficiently rapid to take place between the execution of one fold and the execution of the subsequent fold by the respective folding roller 1 or 3. During movement along this arc the respective separating finger is conveyed along the track 19 to the area in which it is once again engaged by the belt 21. From the position 15Y it is then conveyed by the belt 21 and/or by the push of the folded web material towards the unloading area 9.

In the unloading area the individual packs into which the separating fingers have divided the stacks P1 and P2 of folded products are separated and unloaded. The drawing shows means to separate the packs, comprising a rod 16 movable parallel to its axis, while the unloading means are omitted for simplicity, but are known to those skilled in the art, for example from the publications cited in the introductory part of this description. In particular, in WOA-0214196 the rod 16 is also described in greater detail. It must be understood that other separating and unloading mechanisms may have different configurations and these are not critical for the embodiment of the present invention.

Located at the level of the position of the separating finger is the aforesaid slider or rod 16, marked with 15Z in FIG. 3; Which is inserted between two subsequent packs of folded products at the level of the position of the finger. In this position, the finger is also released from the belt 21, thanks to the specific path it follows along the wheels 35 and 25.

The pack downstream, that is, farther forward than the separating finger in position 15Z, is unloaded in a per se known way, while the one upstream is constrained by the rod 16. The finger in position 15Z can therefore move away, as it is no longer engaged in the operation to constrain or separate the packs of products. For this purpose, it is grasped by a hook 51 carried by a stepwise rotating sprocket 53 and elastically stressed in a centrifugal direction. As can be seen in FIG. 3, the sprocket 53 carries two hooks 51 in diametrically opposed positions. With each angular step of the sprocket (the movement of which may be controlled by a free wheel mechanism analogous to the one described with reference to the inserting sprocket 41 and not shown) the positions of the two hooks 51 are exchanged. Therefore, before each separating finger 15 is brought back to the return section of the track 19, in contact with the belt 21 the sprocket 53 will perform two rotation steps.

Once the separating finger 15 has been pushed by the elastic hook 51 against the portion of belt 21 driven around the wheel 33, it is conveyed by said belt to the position of the wheel 27, where it is once again released from the belt owing to the path followed by the latter around the guiding wheels 27, 29, 31. From here the various fingers are conveyed towards the pick-up position by the sprocket 41 by means of a jet of air, a rotating brush, an auxiliary conveyor belt or other suitable means, not shown, the sole purpose of which is to overcome the slight friction between the separating fingers and the track 19.

Figure 2:
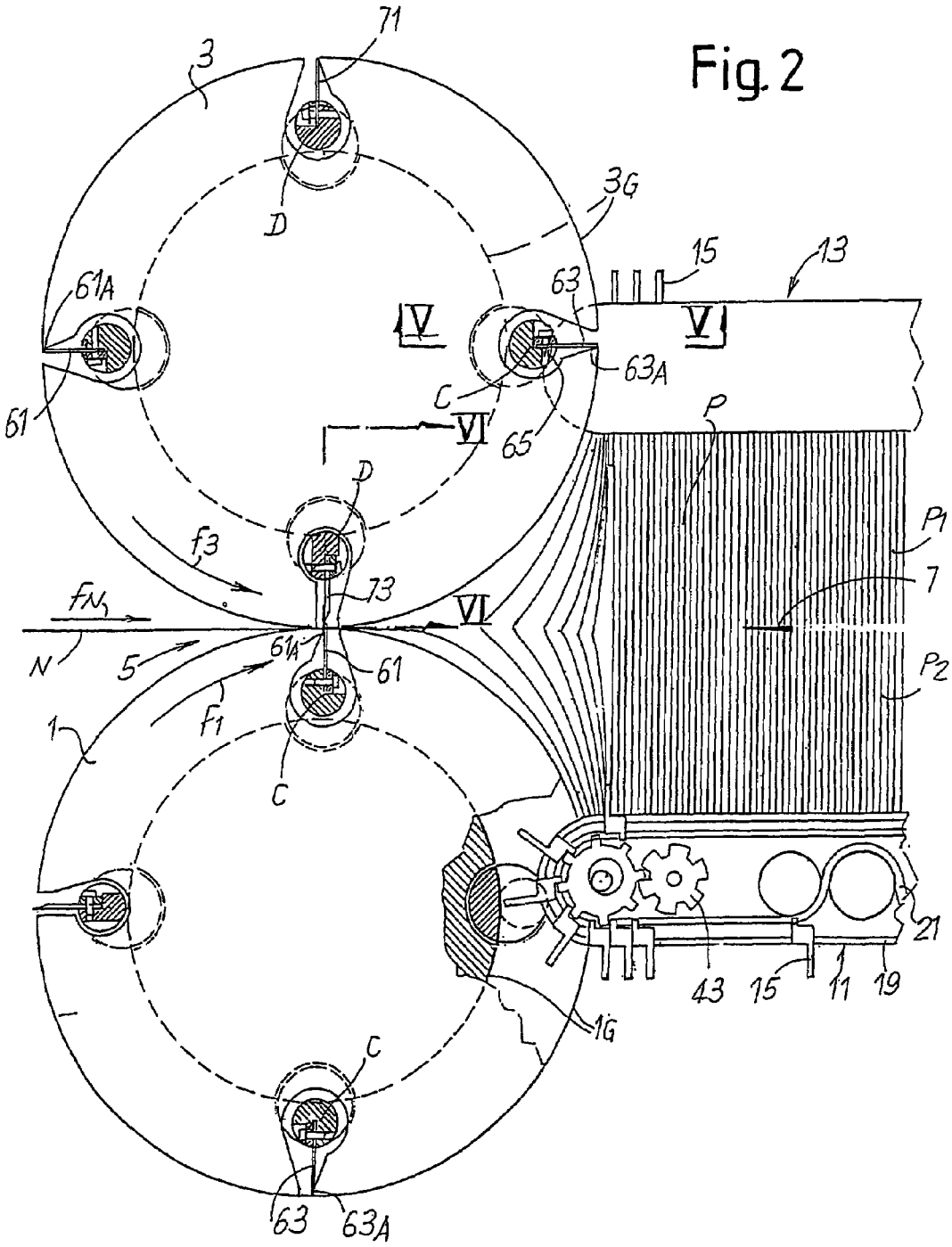
FIG. 2 shows an enlargement of the folding rollers.

The above description principally relates to the system to transfer packs of folded products from the folding area, adjacent to the folding rollers 1 and 3, to the unloading area 9. The folding members on the rollers 1 and 3 may have an essentially known configuration and which shall be described only briefly, highlighting the distinct characteristics with respect to the traditional members. Principally, as can be seen in FIG. 2, and contrary to traditional folding machines, each folding roller 1, 3 has dual folding members, made possible by the fact that the transferring devices 11, 13 interpenetrate the respective rollers to a great extent.

Figure 5:
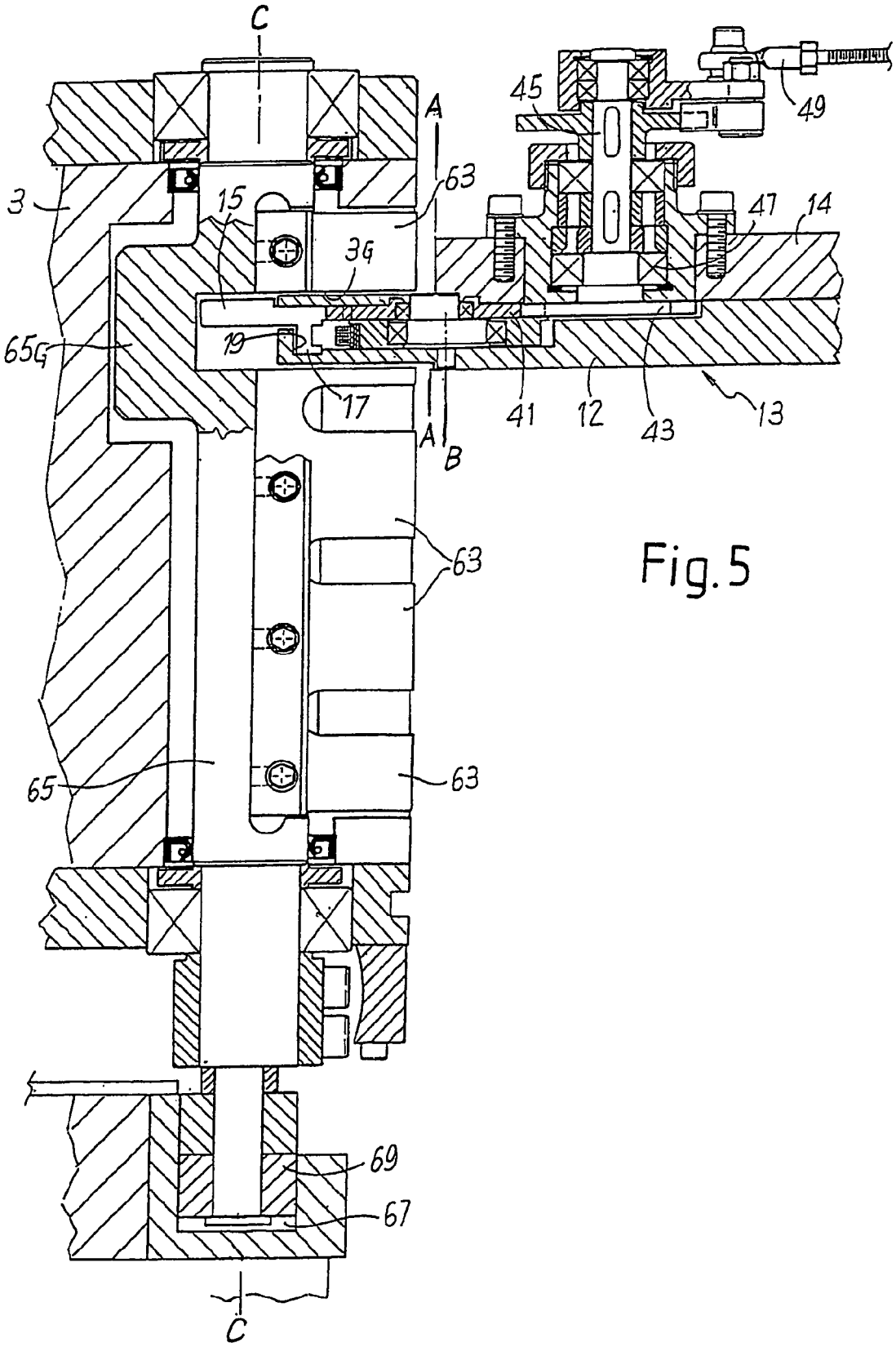
FIGS. 5 and 6 show sections of the folding gripper and of a wedge, according to V-V and VI-VI of FIG. 2 respectively.
Figure 6:
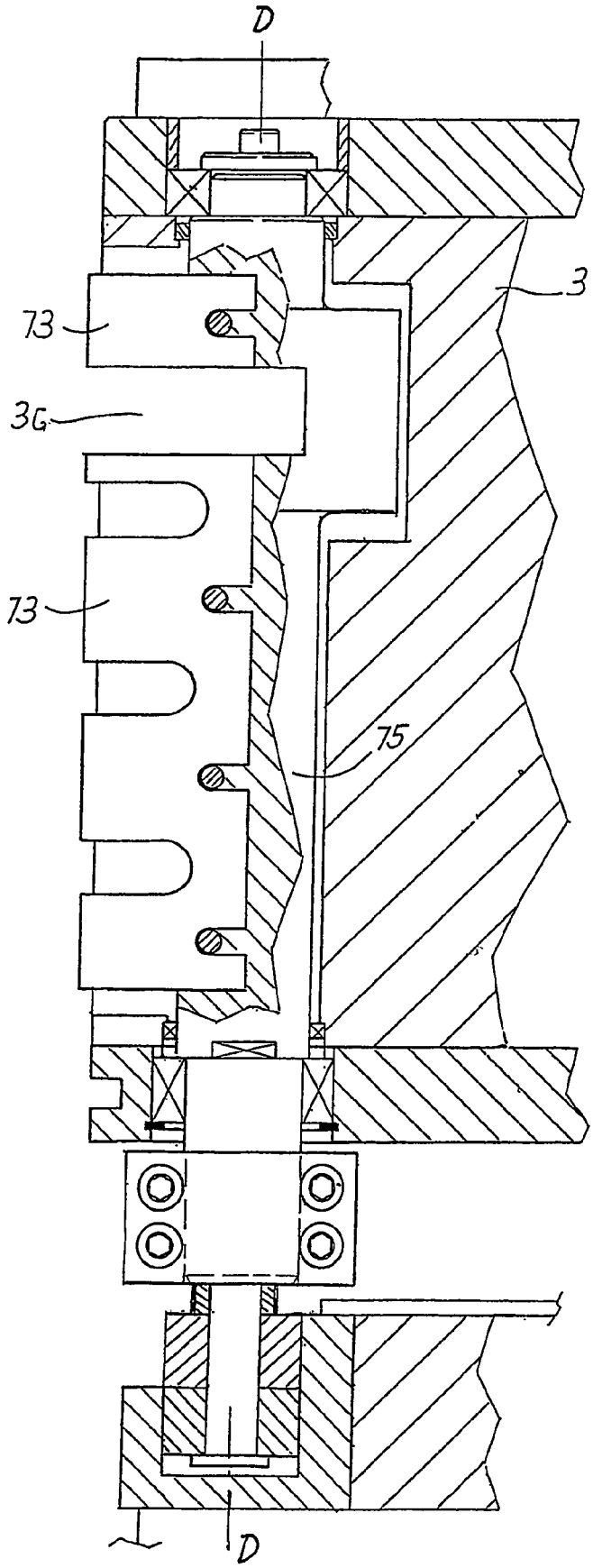

More specifically, each folding roller 1, 3 has two seats parallel to its axis and open towards the outside, inside each of which a folding gripper 61, 63 is housed. The two grippers 61, 63 are located in diametrically opposed positions, and form the actual folding members. The four folding grippers carried by the two rollers 1, 3 are essentially identical. Each folding gripper 61, 63 (see FIG. 5) is constituted by two sections of thin elastic plate, fixed on a single control shaft 65 oscillating about an axis C. At least the lower section is equipped with incisions or notches that allow penetration of combs to detach the web material folded in a zigzag configuration, not shown for clarity and simplicity of the drawing, but known to those skilled in the art.

Characteristically, the shaft 65 has an elbow 65G at the level of the annular groove 1G or 3G of the respective folding roller 1 or 3. This is due to the fact that the transferring device 11 or 13, with its respective separating fingers 15 penetrates the annular groove 1G or 3G to an extent that it interferes with the axis C of the shaft 65. The configuration of this elbow shaft allows continuity to be maintained and positioning of the control members at one end, typically the lower end. These control members are constituted by a desmodromic cam, that is, a channel cam 67 and by a feeler roll 69, in a per se known way.

A wedge or blade 71, 73 cooperates with each folding gripper 61, 63. Each folding roller 1, 3 has two wedges 71, 73 disposed in two seats diametrically opposed and parallel to the axis of the respective roller, which are in turn staggered by 90° with respect to the seats housing the folding grippers 61, 63. Analogously to the grippers 61, 63, the wedges are carried by respective oscillating elbow shafts 75, with axis D. Also in this case the elbow configuration is necessary to avoid interference between the respective transferring device 11, 13 and the shafts 75. Oscillation is controlled by the channel cam 67 (or other suitably positioned cam), with which a feeler roll constrained to the shaft 75 cooperates.

As can be seen in FIG. 2, the folding rollers 1, 3 are phased so that a gripper of one of the rollers and a wedge of the opposed roller always coincide in the folding nip 5. Rotation of the rollers and oscillation of the wedges and of the grippers are synchronized to cause, by means of the wedges 71, 73, the web material to penetrate between the gripper 61 or 63 and the abutment 61A, 63A with which it cooperates. Subsequent elastic closing of the gripper constrains the web material along the folding line, which thus remains adherent to the surface of the respective folding roller 1 or 3 until the point of release, corresponding approximately to a position advanced by 90° with respect to the nip 5, in proximity to which the transferring device is positioned.

The arrangement of the grippers and of the wedges on the two rollers, staggered by 90°, allows the web material N to be folded in a zigzag configuration. The presence of two wedges and two grippers on each of the two rollers makes it possible to perform—contrary to traditional machines—a total of four folds, drastically increasing the production speed to approximately double the speed of traditional machines. This arrangement was not possible with prior art machines, in which the transferring device necessarily had to be disposed at almost 180° from the folding nip, with the consequence that only one folding gripper could be housed on each folding roller. Interpenetration between the transferring device and the folding roller has, vice versa, the advantage of making the transferring device act in an area, along the trajectory of rotation of the folding grippers, advanced by only 90° with respect to the position in which the fold starts, that is, the nip 5. With rollers with double the diameter of traditional rollers the same formats of end product are obtained with a production speed that is twice as fast.

It is understood that the drawing purely shows a non-limiting practical embodiment of the invention, which may vary in forms and layouts without however departing from the scope of the concept on which the invention is based, as defined in the appended claims. Any reference numbers in the claims have the sole purpose of facilitating reading in the light of the description hereinbefore and of the accompanying drawings and do not limit the scope of protection.

The invention claimed is:

1. A folding machine comprising: a pair of folding rollers rotating about axes essentially parallel to each other and defining a nip through which a web material to be folded passes, disposed on each of said rollers folding members being arranged which form folds on said web material parallel to the axis of rotation of the folding rollers; and, for each of said folding rollers, a transferring device to transfer packs of products folded by the folding rollers towards an unloading area, which transferring device includes a plurality of separating fingers movable along a closed path, from an area of engagement with folded products to an unloading area of folded products; wherein said closed path is defined by a track, said separating fingers sliding inside and projecting from said track, and wherein each folding roller is provided with an annular groove into which said separating fingers project; and wherein each said track of each said transferring device extends inside the annular groove of a respective folding roller.

2. Folding machine according to claim 1, wherein each finger of said separating fingers is equipped with a shaped guide base sliding in said track, and wherein each said shaped guide base enters the annular groove of the respective folding roller when moving along said track.

3. Folding machine as claimed in claim 2, wherein on each of said folding rollers at least one folding gripper is provided, oscillating about an axis parallel to the axis of rotation of the respective folding roller, interrupted at a level of said annular groove.

4. Folding machine as claimed in claim 3, wherein each of said at least one folding gripper is equipped with an oscillating control shaft, which has an elbow configuration at the level of the annular groove, the transferring device interfering with the axis of oscillation of said control shaft.

5. Folding machine as claimed in claim 2, wherein on each of said folding rollers at least two folding members are provided.

6. Folding machine as claimed in claim 1, wherein on each of said folding rollers at least one folding gripper is provided, oscillating about an axis parallel to the axis of rotation of the respective folding roller, interrupted at a level of said annular groove.

7. Folding machine as claimed in claim 6, wherein on each of said folding rollers at least two folding members are provided.

8. Folding machine as claimed in claim 6, wherein each of said at least one folding gripper is equipped with an oscillating control shaft, which has an elbow configuration at the level of the annular groove, the transferring device interfering with the axis of oscillation of said control shaft.

9. Folding machine as claimed in claim 1, wherein on each of said folding rollers at least two folding members are provided.

10. Folding machine as claimed in any one of claims 1,2,3,4,5,6,7,8,9, wherein each said transferring device comprises a continuous flexible member to convey the separating fingers along said closed path.

11. Folding machine as claimed in claim 10, wherein said continuous flexible member is a belt comprising a base layer and a shaped coating cooperating with corresponding slots in bases of the separating fingers.

12. Folding machine as claimed in claim 1, wherein each transferring device includes a sliding track defining said closed path for said separating fingers which extend approximately orthogonal to said track and have respective guide bases engaging slidingly in said track; the track having an essentially rectilinear forward section extending from the folding rollers to said unloading area of the packs of products, and a return section; said forward section and said return section being connected by a first curvilinear end portion adjacent to the folding rollers and a second curvilinear end portion adjacent to the unloading area, the first curvilinear end portion intersecting the cylindrical surface of the respective folding roller.

13. Folding machine as claimed in claim 12, wherein each said transferring device comprises a continuous flexible member to convey the separating fingers along said closed path and said flexible member cooperates with the guide bases of the respective fingers.

14. Folding machine as claimed in claim 13, wherein said flexible member is inside the closed path followed by the guide bases of said fingers, remaining constrained in a vertical space of said guide bases.

15. Folding machine as claimed in claim 14, wherein said flexible member acts on a surface of said guide bases facing inside of the closed path defined by said track.

16. Folding machine as claimed in claim 12, wherein a rotating inserting member is associated with the first curvilinear end portion of said track, to pick up the separating fingers from the return section of said track and insert the fingers in the forward section of said track, making said fingers travel along the corresponding curvilinear end portion of said track.

17. Folding machine as claimed in claim 16, wherein said rotating inserting member penetrates said annular groove in the corresponding folding roller.

18. Folding machine as claimed in claim 16, wherein each said transferring device comprises a continuous flexible member to convey the separating fingers along said closed path and wherein along a terminal part of the return section of the track and along part of the first curvilinear end portion of said track the separating fingers are not in contact with said flexible member.

19. Folding machine as claimed in claim 18, wherein said flexible member is driven around a first guiding wheel associated with said rotating inserting member, axis of rotation of the first guiding wheel and axis of rotation of the rotating inserting member being parallel and eccentric.

20. Folding machine as claimed in claim 19, wherein eccentricity of said axis of rotation of the first guiding wheel of the flexible member and said axis of rotation of the rotating inserting member, diameter of said first guiding wheel and diameter of the first curvilinear end portion of the track of the separating fingers being arranged and dimensioned so that bases of the fingers are not in contact with the flexible member for an angle ranging from approximately 90° to approximately 160° of the first curvilinear end portion of the track, the fingers being brought into contact with the flexible member by the rotating inserting member at the end of said first curvilinear end portion of the track.

21. Folding machine as claimed in claim 19, wherein said first guiding wheel is at least partially inside said annular groove in the respective folding roller.

22. Folding machine as claimed in claim 21, wherein said rotating inserting member is controlled by means of a driving wheel meshing with said rotating inserting member, positioned on an outside of said annular groove.

23. Folding machine as claimed in claim 12, wherein a rotating sprocket is disposed at a level of said second curvilinear end portion of the track of the separating fingers to pick up the fingers from the forward rectilinear section and transfer the fingers to the return section of said track.

24. Folding machine as claimed in claim 23, wherein each said transferring device comprises a continuous flexible member to convey the separating fingers along said closed path and wherein at the level of said second curvilinear end portion the continuous flexible member is not in contact with the bases of the separating fingers.

* * * * *